US007971913B2

(12) United States Patent
Sunahara et al.

(10) Patent No.: US 7,971,913 B2
(45) Date of Patent: Jul. 5, 2011

(54) DOOR HANDLE DEVICE FOR VEHICLE

(75) Inventors: Shigeyuki Sunahara, Toyota (JP); Tetsurou Tanimoto, Anjo (JP); Koichi Nagata, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 547 days.

(21) Appl. No.: 11/632,827

(22) PCT Filed: Jul. 21, 2005

(86) PCT No.: PCT/JP2005/013382

§ 371 (c)(1),
(2), (4) Date: Jan. 19, 2007

(87) PCT Pub. No.: WO2006/009205

PCT Pub. Date: Jan. 26, 2006

(65) Prior Publication Data

US 2008/0088139 A1 Apr. 17, 2008

(30) Foreign Application Priority Data

Jul. 23, 2004 (JP) ..... 2004-215184
Jun. 24, 2005 (JP) ..... 2005-185047
Jun. 27, 2005 (JP) ..... 2005-187069

(51) Int. Cl.
*E05B 3/00* (2006.01)

(52) U.S. Cl. ..... 292/336.3; 292/348; 292/DIG. 27

(58) Field of Classification Search ..... 292/336.3, 292/347–356, DIG. 23, DIG. 27, DIG. 30, 292/DIG. 31; 49/503
See application file for complete search history.

(56) References Cited

U.S. PATENT DOCUMENTS 4,343,501 A * 8/1982 Meeks ..... 292/336.3
4,475,754 A * 10/1984 Arlauskas et al. ..... 292/336.3
4,497,514 A * 2/1985 Moriya et al. ..... 292/336.3
5,651,163 A 7/1997 Tamaki
6,240,755 B1 * 6/2001 Da Silva ..... 70/423
6,363,577 B1 * 4/2002 Spitzley ..... 292/336.3
(Continued)

FOREIGN PATENT DOCUMENTS

JP 46-27928 U 9/1971
(Continued)

OTHER PUBLICATIONS

English language version of International Preliminary Report on Patentability and attached Written Opinion, issued by the International Bureau of WIPO in corresponding International Application No. PCT/JP205/013382, Geneva, CH.

(Continued)

*Primary Examiner* — Carlos Lugo
*Assistant Examiner* — Mark Williams
(74) *Attorney, Agent, or Firm* — Buchanan Ingersoll & Rooney PC

(57) ABSTRACT

A base member is fixed to a rear surface of a door panel for a vehicle. A grip member is supported on the base member in a tiltable manner. The grip member is arranged on the base member from a front surface of the door panel. A pivot shaft is arranged on the grip member. A shaft supporting member supports the pivot shaft with respect to the base member so that the pivot shaft can pivot relative to the base member. As a result, the grip member is ensurely prevented from becoming loose with respect to the base member in a longitudinal direction of the grip member.

16 Claims, 15 Drawing Sheets

U.S. PATENT DOCUMENTS

| | | | | |
|---|---|---|---|---|
| 6,447,030 | B1 * | 9/2002 | Meinke | 292/347 |
| 6,543,090 | B2 * | 4/2003 | Muneta | 16/412 |
| 6,588,813 | B1 * | 7/2003 | Marcarini et al. | 292/347 |
| 6,594,861 | B2 * | 7/2003 | Dimig et al. | 16/412 |
| 6,719,336 | B2 * | 4/2004 | Sato | 292/336.3 |
| 6,740,834 | B2 * | 5/2004 | Sueyoshi et al. | 200/600 |
| 6,765,472 | B2 * | 7/2004 | Suparschi et al. | 340/5.62 |
| 7,029,054 | B2 * | 4/2006 | Kobayashi et al. | 296/146.1 |
| 7,036,857 | B2 * | 5/2006 | Ichino | 292/347 |
| 7,827,736 | B2 * | 11/2010 | Sunahara et al. | 49/503 |

FOREIGN PATENT DOCUMENTS

| | | | |
|---|---|---|---|
| JP | 6-23656 | Y2 | 6/1994 |
| JP | 6-39006 | Y2 | 10/1994 |
| JP | 08-004367 | A | 1/1996 |
| JP | 10-8786 | A | 1/1998 |
| JP | 2001-227205 | A | 8/2001 |
| JP | 2002-004649 | A | 1/2002 |
| JP | 2002-227462 | A | 8/2002 |
| JP | 2003-3696 | A | 1/2003 |
| JP | 2003-13629 | A | 1/2003 |
| JP | 3468281 | B2 | 9/2003 |
| JP | 2004-60180 | A | 2/2004 |
| JP | 2004-68387 | A | 3/2004 |

OTHER PUBLICATIONS

Office Action issued by the Japanese Patent Office on Dec. 22, 2009 in Japanese Patent Application No. 2004-215184 and an English language translation thereof.

* cited by examiner

DOOR HANDLE DEVICE FOR VEHICLE

FIELD OF THE INVENTION

The present invention relates to a vehicle door handle device.

BACKGROUND OF THE INVENTION

Patent Publications 1 and 2 discuss examples of conventional door handle devices, as will be described later. This door handle will be described with reference to FIG. 20.

The door handle device includes a frame 112 fixed to a rear surface 111*b* of a door panel 111 for a vehicle, a grip 113 arranged on the frame 112 at a front surface 111*a* of the door panel 111, and a lever 114 supported on the frame 112 in a pivotal manner. An engagement leg portion 113*a* is formed on a first end (left end in FIG. 20) of the grip 113 in the longitudinal direction (horizontal direction in FIG. 20). The engagement leg portion 113*a* is engaged with a support portion 112*a* arranged on the frame 112. The grip 113 is supported on the frame 112 in a manner tiltable about the engagement leg portion 113*a*. An engagement arm portion 113*b*, which is engaged with the lever 114, is formed on a second end (right end in FIG. 20) of the grip 113 in the longitudinal direction. The lever 114 is connected to a rod (not shown) or the like for actuating a door lock device (not shown).

In the state shown in FIG. 20, when the grip 113 is pulled in the outward direction of the vehicle (upward in FIG. 20) with respect to the door panel 111 (opening operation), the grip 113 tilts about the engagement leg portion 113*a* that is engaged with the support portion 112*a* of the frame 112 in the outward direction of the vehicle with respect to the frame 112. This operation pivots the lever 114, which is engaged with the engagement arm portion 113*b* of the grip 113, and unlocks the door lock device, which is connected to the lever 114 to enable the door (not shown) to open.

Patent Publication 1: Japanese Laid-Open Patent Publication No. 2002-4649

Patent Publication 2: Japanese Laid-Open Patent Publication No. 2002-227462

SUMMARY OF THE INVENTION

In this way, when the opening operation of the door handle device described above is performed, the grip 113 tilts about the engagement leg portion 113*a* that is engaged with the support portion 112*a* of the frame 112 in the outward direction of the vehicle with respect to the frame 112. However, the position of the engagement leg portion 113*a* of the grip 113 is not restricted in the longitudinal direction of the grip 113 with respect to the position of the support portion 112*a* of the frame 112 supporting the engagement leg portion 113*a*. In other words, in this structure, the position of the point about which the grip 113 tilts with respect to the frame 112 is not kept constant in the longitudinal direction of the grip 113. More specifically, the engagement leg portion 113*a* of the grip 113 may move in the longitudinal direction of the grip 113 with respect to the support portion 112*a* of the frame 112. Thus, when the opening operation of the grip 113 is performed, the grip 113 (grip member) may be loose with respect to the frame 112 (base member) in the longitudinal direction of the grip 113.

It is an object of the present invention to provide a door handle device for a vehicle that ensures prevention of the grip member from becoming loose with respect to a base member in a longitudinal direction of the grip member.

To achieve the above object, a vehicle door handle according to the present invention includes a base member fixed to a rear surface of a door panel for a vehicle and a grip member arranged on the base member from a front surface of the door panel so that the grip member is supported on the base member in a tiltable manner. A pivot shaft is arranged on the grip member. A shaft supporting member supports the pivot shaft with respect to the base member. The shaft supporting member restricts movement of the pivot shaft in the longitudinal direction of the grip member with respect to the base member.

Preferably, the grip member may include a support arm having a pair of opposing walls facing toward each other. The pivot shaft is arranged on the support arm to connect the opposing walls to each other. The shaft supporting member is accommodated between the opposing walls.

Preferably, the shaft supporting member may have a shaft supporting recess for supporting the pivot shaft in a pivotal manner.

Further, a shaft supporting recess for pivotally supporting the pivot shaft may be arranged in the base member.

DETAILED DESCRIPTION OF THE PREFERRED EMBODIMENT

A first embodiment of the present invention will now be described with reference to the drawings.

Figure 1:
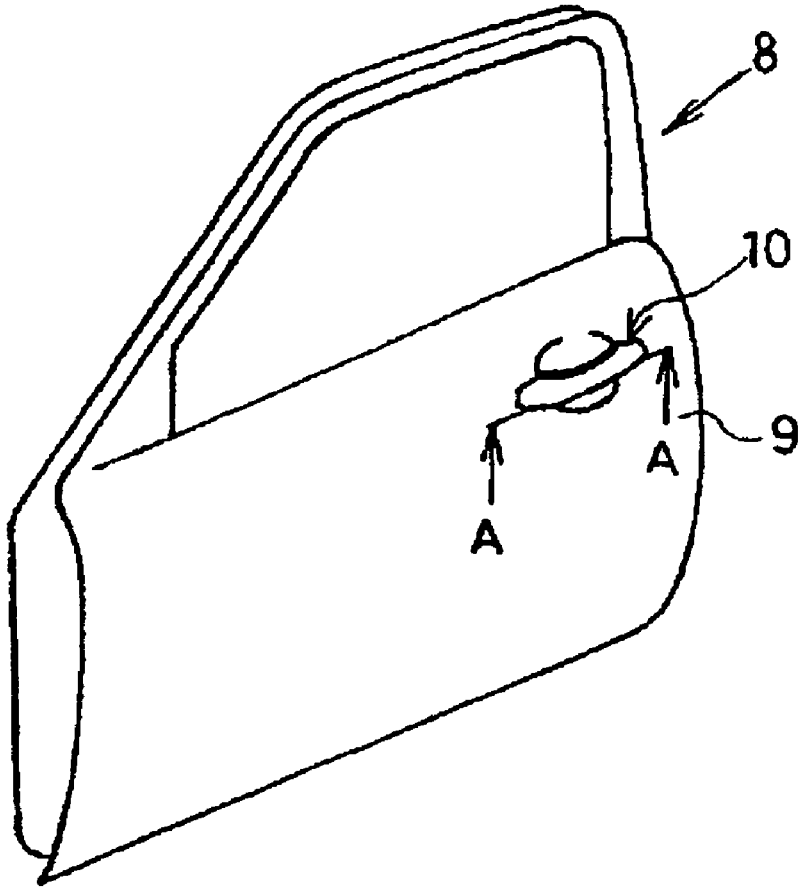
FIG. 1 is a perspective view showing a vehicle door on which a vehicle door handle device according to a first embodiment of the present invention is installed.

FIG. 1 is a perspective view showing a vehicle door 8. Although the door 8 is described as a side door for a vehicle in the present embodiment, the door 8 is not limited in such a manner and may be a back door for a vehicle. An outside handle device 10 (vehicle door handle) is arranged on an outer panel 9 (door panel) of the door 8. The outside handle device 10 is operated to open and close the door 8 with respect to the body (not shown) of the vehicle.

Figure 2:
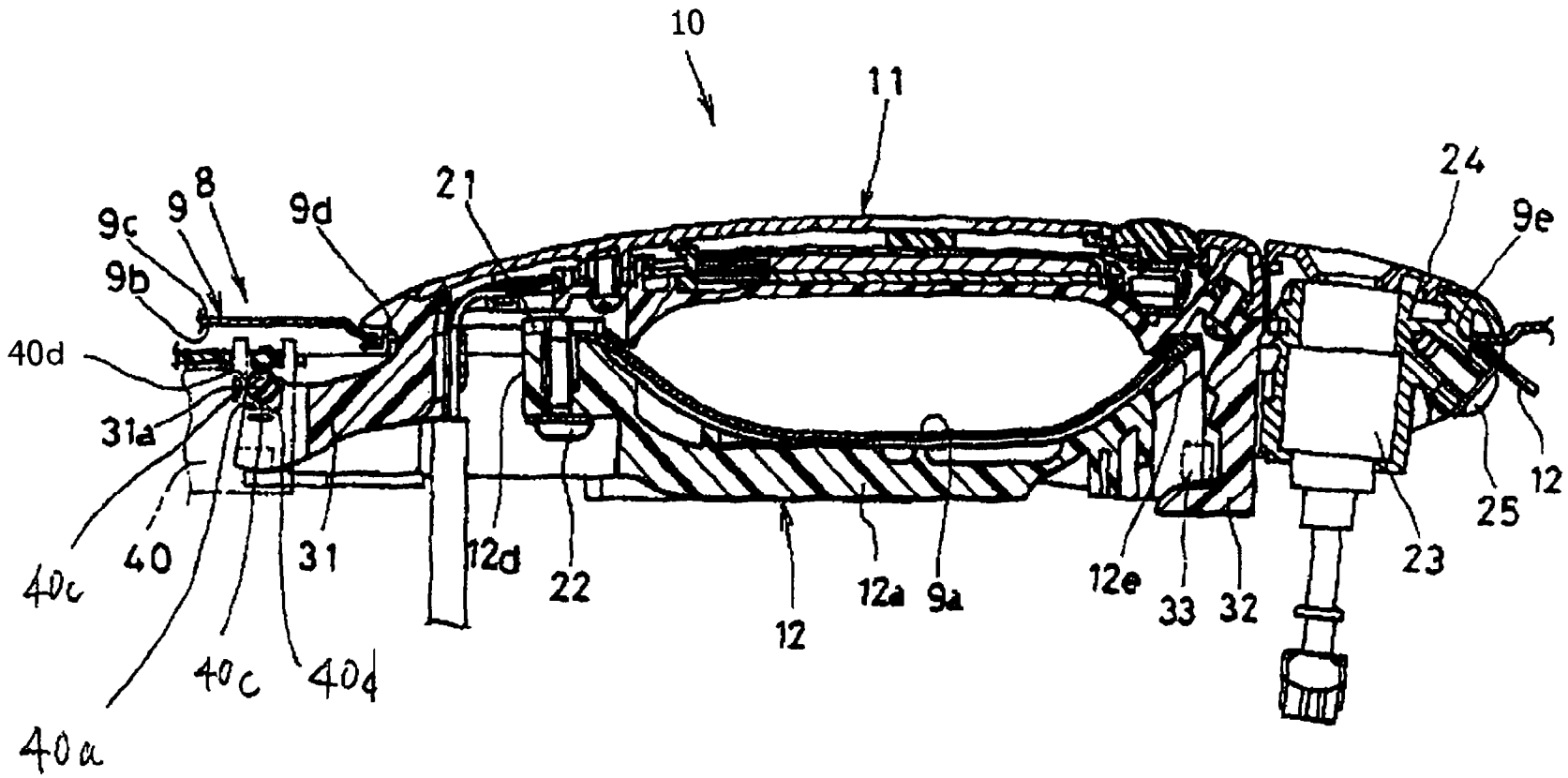
FIG. 2 is a cross-sectional view taken along line A-A of FIG. 1.

FIG. 2 is a cross-sectional view taken along line A-A in FIG. 1 and shows a state in which the outside handle device 10 is arranged on the outer panel 9 of the door 8.

The outside handle device 10 includes a handle grip 11 (grip member) and a handle frame 12 (base member).

The handle frame 12 includes a curved portion 12*a* at the middle part in the longitudinal direction (horizontal direction in FIG. 2). The curved portion 12*a* conforms to a recess 9*a* formed in the outer panel 9. Two frame openings 12*d* and 12*e* are formed on both ends of the handle frame 12 in the longitudinal direction with the curved portion 12*a* arranged in between. Panel openings 9*d* and 9*e* are also formed in the outer panel 9. When the handle frame 12 is fixed to the outer panel 9, the frame openings 12*d* and 12*e* are aligned with the panel openings 9*d* and 9*e*, respectively.

The two ends of the handle frame 12 in the longitudinal direction with the curved portion 12*a* arranged in between are fixed to an inner door surface 9*b* (rear surface) of the outer panel 9. A key cylinder 23 and a cap 24 covering the key cylinder 23 are arranged on the frame opening 12*e* on the second end (right end in FIG. 2) of the handle frame 12. A screw 25 is arranged on the second end of the handle frame 12. The screw 25 connects the handle frame 12 and the key cylinder 23. When the screw 25 is fastened, the handle frame 12 and the key cylinder 23 hold the outer panel 9 in between. This holding force fastens the second end of the handle frame 12 to the outer panel 9.

The first end (left end in FIG. 2) of the handle frame 12 is fixed to the outer panel 9 by a nut 21 and a screw 22. The nut 21 is configured to hold the outer panel 9 between the nut 21 and the handle frame 12. When the screw 22 is fastened into the nut 21, the nut 21 and the handle frame 12 hold the outer panel 9 in between. This fastens the handle frame 12 to the outer panel 9.

The handle grip 11 is rectangular and includes a support arm 31 and an actuation arm 32.

The actuation arm 32 is formed on the second end (right end in FIG. 2) of the handle grip 11 in the longitudinal direction (horizontal direction in FIG. 2) of the handle grip 11. The actuation arm 32 extends toward the door 8 (downward in FIG. 2). The actuation arm 32 extends through the panel opening 9*e* of the outer panel 9 into the door 8 and is supported within the frame opening 12*e* of the handle frame 12. This connects the actuation arm 32 of the handle grip 11 to the door 8. Further, the distal end (lower end in FIG. 2) of the actuation arm 32 is engaged with a bell crank arm 33. The bell crank arm 33 is connected to a door lock device (not shown) arranged within the door 8 by a rod or the like (not shown).

The support arm 31 is formed on the first end (left end in FIG. 2) of the handle grip 11 in the longitudinal direction. The support arm 31 extends through the panel opening 9*d* of the outer panel 9 into the door 8 and is inserted in the frame opening 12*d* of the handle frame 12. More specifically, the handle grip 11 is attached to the handle frame 12 at an outer door surface 9*c* (front surface) of the outer panel 9. A shaft 31*a* (pivot shaft or tilt shaft) is arranged on the distal end (left end in FIG. 2) of the support arm 31. A fastening piece 40 (shaft supporting member) is arranged within the frame opening 12*d* of the handle frame 12. The fastening piece 40 supports the shaft 31*a* in a manner that the support arm 31 is tiltable. This connects the support arm 31 of the handle grip 11 to the door 8. Hereafter, the structure of the shaft 31*a* for the support arm 31 and the structure of the fastening piece 40 will be described with reference to FIGS. 3 and 4.

Figure 3:
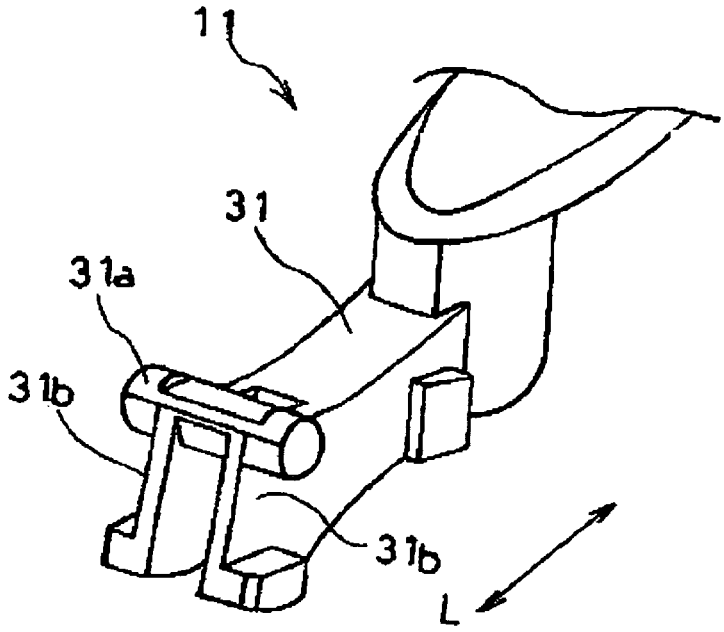
FIG. 3 is a perspective view showing a support arm of a handle grip included in the vehicle door handle device of FIG. 2.

FIG. 3 is a perspective view showing the support arm 31 of the handle grip 11. A pair of opposing walls 31*b* is arranged on the distal end of the support arm 31. The fastening piece 40 (refer to FIG. 2 and FIG. 4) is accommodated between the two opposing walls 31*b*. The shaft 31*a* of the support arm 31 connects the two opposing walls 31*b*. The shaft 31*a* extends in a direction perpendicular to the longitudinal direction (L direction in FIG. 3) of the handle grip 11 and is cylindrical.

Figure 4:
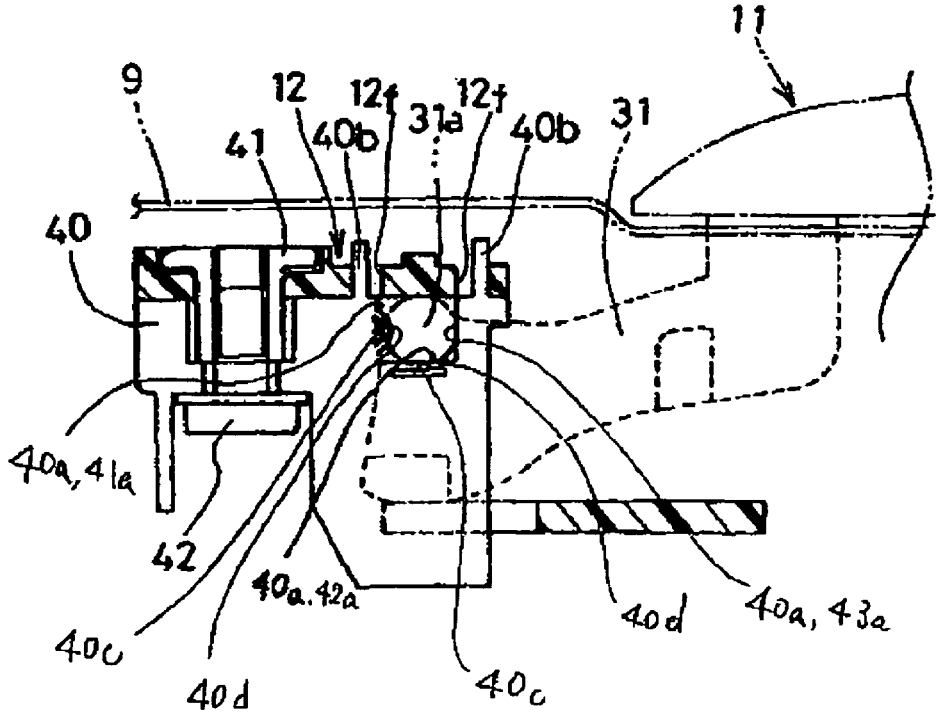
FIG. 4 is a cross-sectional view showing a support structure of the vehicle door handle device of FIG. 2 in which a fastening piece supports the support arm.

FIG. 4 shows a support structure in which the fastening piece 40 supports the support arm 31. The shaft 31*a* of the support arm 31 is supported on the handle frame 12 by the fastening piece 40. The fastening piece 40 is fixed to the handle frame 12 by a nut 41 and a screw 42. A support portion 40*a* (shaft supporting recess) is arranged on the fastening piece 40. The shaft 31*a* of the support arm 31 is accommodated in the support portion 40*a*. The support portion 40*a* is formed as a recess corresponding to the shape of the shaft 31*a*. The shaft 31*a* of the support arm 31 is supported on the support portion 40*a* in a manner that the shaft 31*a* is rotatable.

The fastening piece 40 has through-holes 40*c* formed in the vicinity of the support portion 40*a*. More specifically, the support portion 40*a* is formed by three inner walls 41*a* to 43*a*. The inner walls 41*a* to 43*a* are formed to extend in the same direction as the shaft 31*a*. The through-holes 40*c* are formed around the support portion 40*a*. In the present embodiment, two through-holes 40*c* are formed in a manner that one through hole 40*c* is located at the side of the inner wall 41*a* of the support portion 40*a* (right side in FIG. 4) and the other through hole 40*c* is located at the side of the inner wall 42*a* (lower side in FIG. 4). The through-holes 40*c* are formed to permit the shaft 31*a* to extend (in the axial direction of the shaft 31*a*) through the fastening piece 40. The fastening piece 40 has flexible portions 40*d* corresponding to the through-holes 40*c*. More specifically, the flexible portions 40*d* are formed by the through-holes 40*c* and the inner walls of the support portion 40*a*. In the present embodiment, two flexible portions 40*d* are formed by the through-holes 40*c* and the inner walls 41*a* and 42*a* of the support portion 40*a*. In detail, a portion of the fastening piece 40 (shaft supporting member) between each through hole 40*c* and the corresponding one of the inner walls 41*a* and 42*a* of the support portion 40*a* (shaft supporting recess) form each flexible portion 40*d*. The flexible portions 40*d* come in contact with the shaft 31*a*. The flexible portions 40*d* are formed between the through-holes 40*c* and the support portion 40*a* so as to form thin portions. As a result, each flexible portion 40*d* is flexibly deformable in a recessed manner within a predetermined range so as to deform the corresponding through hole 40*c*. The dimensions of the shaft 31*a* and the support portion 40*a* are set in a manner that the flexible portions 40*d* are constantly deformed to some extent to come in contact with the shaft 31*a* when the shaft 31*a* is accommodated in the support portion 40*a*. More specifically, dimensional differences between the shaft 31*a* and the support portion 40*a* are absorbed by the through-holes 40*c* and the flexible portions 40*d*. This prevents the support arm 31 from loosening with respect to the fastening piece 40. The through-hole 40*c* and the flexible portion 40*d* may be formed on at least one of the inner walls 41*a* to 43*a* of the support portion 40*a*.

Further, a pair of guide portions 40*b* is arranged on the fastening piece 40. A pair of attachment holes 12*f* corresponding to the pair of guide portions 40*b* is arranged on the handle frame 12. To fix the fastening piece 40 to the handle frame 12, the guide portions 40*b* are inserted through the attachment holes 12*f* in a state in which the shaft 31*a* of the support arm 31 is accommodated in the support portion 40*a*. At this point, the fastening piece 40 is positioned with respect to the handle frame 12 in the longitudinal direction of the handle grip 11. In this state, the fastening piece 40 is fixed to the handle frame 12 by the nut 41 and the screw 42. As a result, the shaft 31*a* of the support arm 31 is supported on the handle frame 12 in the longitudinal direction of the handle grip 11. In other words, the position of the shaft 31*a* with respect to the fastening piece 40 in the longitudinal direction of the handle grip 11 is restricted. More specifically, the handle grip 11 is configured to be tiltable about the shaft 31*a* of the support arm 31 in the outward direction of the vehicle (upward in FIG. 4) with respect to the handle frame 12.

Figure 5:
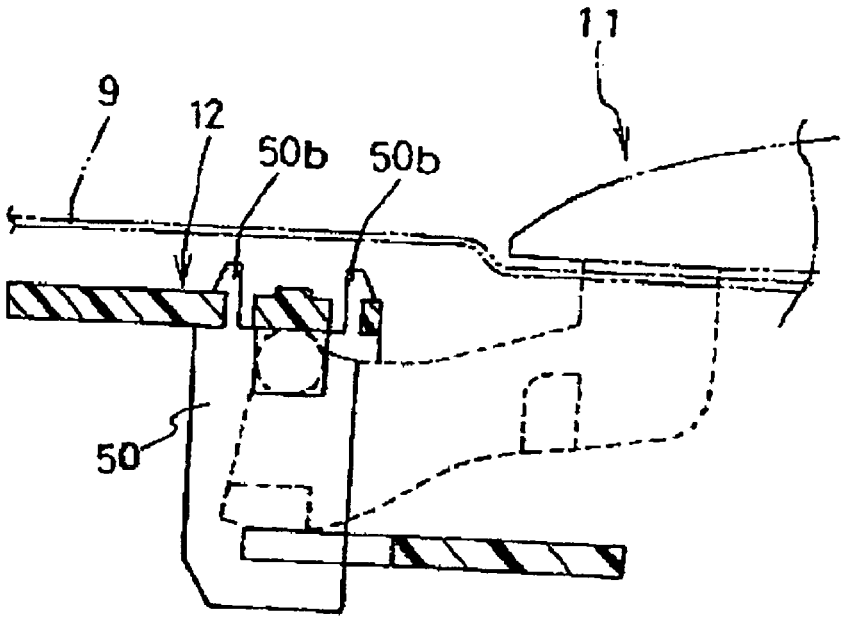
FIG. 5 is a cross-sectional view showing a support structure in which a fastening piece of a modification supports a support arm.

Although the fastening piece 40 is fixed to the handle frame 12 by the nut 41 and the screw 42 in the above-described example, a structure for fixing a fastening piece 50 to a handle frame 12 should not be limited to this structure. For example, as shown in FIG. 5, distal portions of two guide portions 50*b* of the fastening piece 50 may be formed into hooks, and the guide portions 50*b* may be engaged with the handle frame 12. In this case, the fastening piece 50 is fixed to the handle frame 12 without using the nut 41 and the screw 42 shown in FIG. 4. Thus, the fastening piece 50 is easily attached to the handle frame 12. Further, the structure of the fastening piece 50 is simplified.

A second embodiment of the present invention will now be described with reference to FIGS. 6 and 7. The second embodiment differs from the first embodiment in the structure of the support arm 31 of the handle grip 11 and the support structure in which the handle frame 12 supports the shaft 31*a* of the support arm 31. The other components of the second embodiment are common to the first embodiment, and the common components will not be described in detail.

Figure 6:
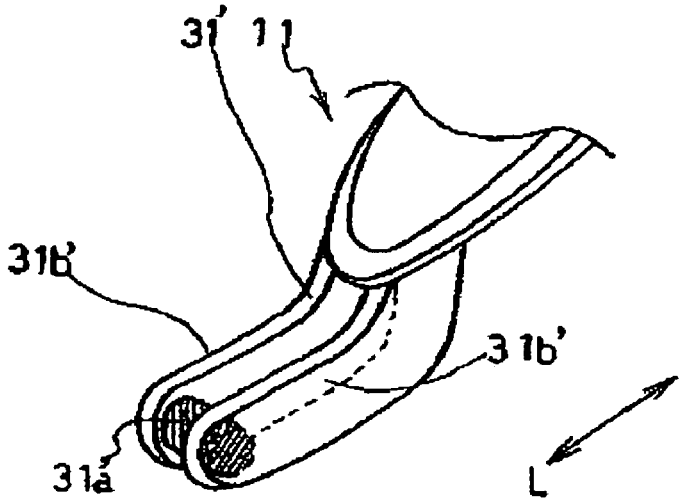
FIG. 6 is a perspective view showing a support arm of a handle grip according to a second embodiment of the present invention.

FIG. 6 is a perspective view showing a support arm 31' of a handle grip 11. A pair of opposing walls 31*b'* is arranged on the support arm 31'. A fastening piece 40' (shaft supporting member) (refer to FIG. 7) is accommodated between the two opposing walls 31*b'*. A shaft 31*a'* (tilt shaft) is arranged on the distal end of the support arm 31' to connect the two opposing walls 31*b'*. The shaft 31*a'* extends in a direction perpendicular to the longitudinal direction of the handle grip 11 (L direction in FIG. 6) and is cylindrical.

Figure 7:
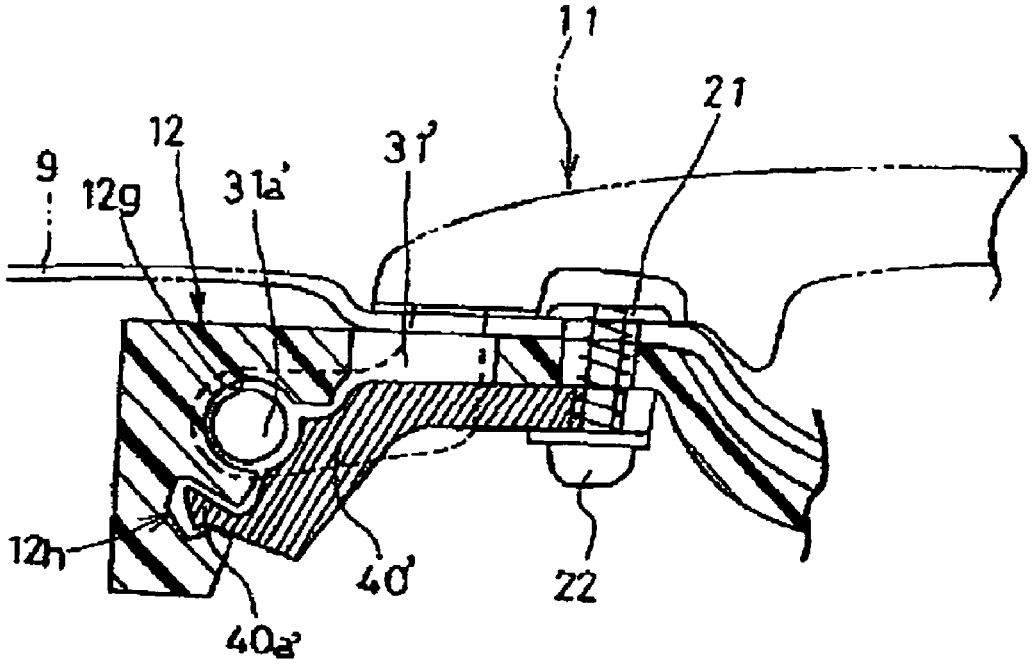
FIG. 7 is a cross-sectional view showing a support structure in which a fastening piece of the second embodiment supports the support arm of FIG. 6.

FIG. 7 shows a support structure in which the fastening piece 40' supports the support arm 31'. The shaft 31*a'* of the support arm 31' is supported on the handle frame 12 by the fastening piece 40'. The shaft 31*a'* of the support arm 31' is accommodated in the support portion 12*g* (shaft supporting recess) arranged on the handle frame 12. The support portion 12*g* is formed as a recess corresponding to the shape of the shaft 31*a'*. The shaft 31*a'* of the support arm 31' is supported so that it is rotatable about the support portion 12*g*.

A first end (right end in FIG. 7) of the fastening piece 40' is fixed to the handle frame 12. In the present embodiment, a nut 21 and a screw 22 (refer to FIG. 2) fasten the fastening piece 40' to an outer panel 9 together with the handle frame 12. In this way, the fastening piece 40' is fixed to the handle frame 12.

A second end (left end in FIG. 7) of the fastening piece 40' is engaged with the handle frame 12 by a guide hook 40*a'*. To fix the fastening piece 40' to the handle frame 12, the guide hook 40*a'* is first engaged with an engagement portion 12*h* of the handle frame 12 while the shaft 31*a'* of the support arm 31' is accommodated in the support portion 12*g*. At this point, with the fastening piece 40' preventing the support portion 12*g* from coming out, the fastening piece 40' is positioned with respect to the handle frame 12 in the longitudinal direction of the handle grip 11. In this state, the fastening piece 40' is fixed to the handle frame 12 by the nut 21 and the screw 22. As a result, the shaft 31*a'* of the support arm 31' is supported on the handle frame 12 in the longitudinal direction of the handle grip 11. In this case, the position of the shaft 31*a'* with respect to the fastening piece 40' in the longitudinal direction of the handle grip 11 is restricted. More specifically, the handle grip 11 is configured to be tiltable about the shaft 31*a'* of the support arm 31' in the outward direction of the vehicle (upward in FIG. 7) with respect to the handle frame 12.

The operation of the outside handle device 10 will now be described briefly with reference to FIG. 2.

To open the door 8, a hand is placed in a space formed between the handle grip 11 and the outer panel 9 to pull the handle grip 11 in the outward direction of the vehicle (upward in FIG. 2). As a result, the handle grip 11 tilts about the shaft 31*a* of the support arm 31 in the outward direction of the vehicle with respect to the handle frame 12. The actuation arm 32 of the support arm 31 is moved in the outward direction of the vehicle to actuate the bell crank arm 33 that is engaged with the actuation arm 32. This actuates a latch mechanism (not shown) of the door lock device and enables the door 8 to open with respect to the body of the vehicle.

As described above, in the outside handle device 10 of the present invention, the shaft 31*a* arranged on the support arm 31 of the handle grip 11 is held on the handle frame 12 by the fastening piece 40 in the longitudinal direction of the handle grip 11. As a result, the position of the shaft 31*a* of the handle grip 11 with respect to the handle frame 12 in the longitudinal direction of the handle grip 11 is restricted. More specifically, the position of the point about which the handle grip 11 tilts with respect to the handle frame 12 is kept constant in the longitudinal direction of the handle grip 11. This ensures that the handle grip 11 is prevented from becoming loose with respect to the handle frame 12 in the longitudinal direction of the handle grip 11. As a result, the operational feel of the handle grip 11 associated with actuation of the door 8 is improved, and the merchantability (quality) of the outside handle device 10 is enhanced.

Figure 8:
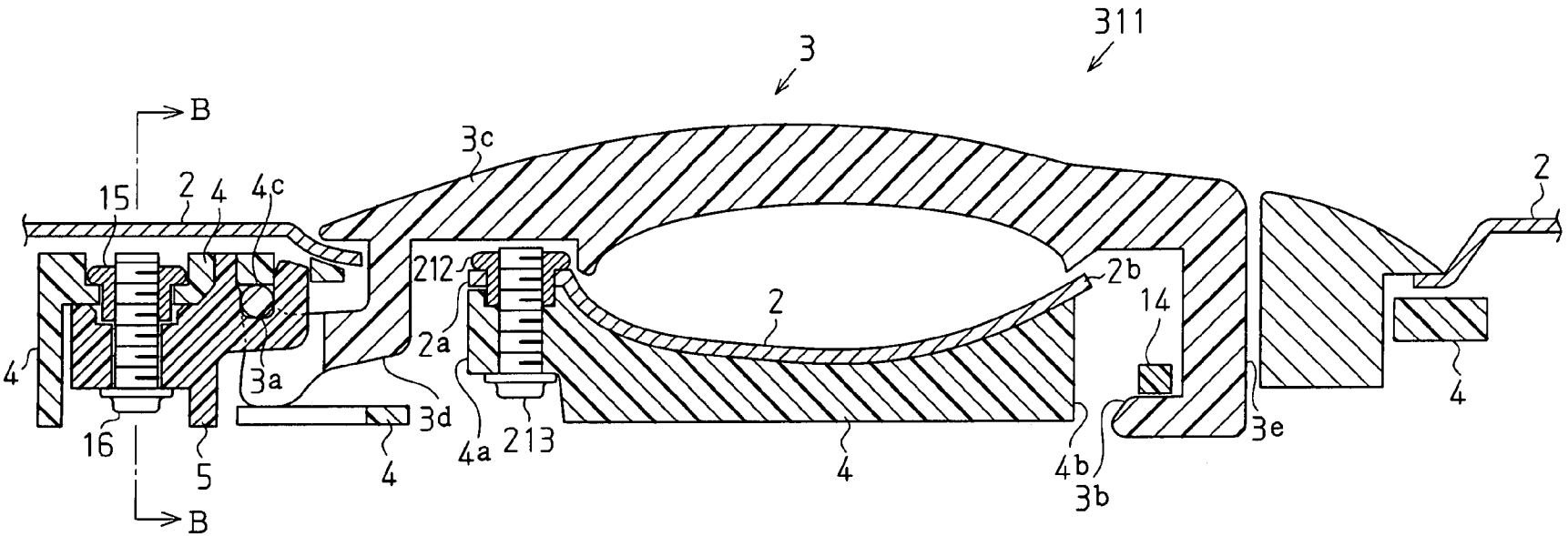
FIG. 8 is a cross-sectional view of a door handle device for a vehicle according to a third embodiment of the present invention.

A vehicle door handle device according to a third embodiment of the present invention will now be described. As shown in FIG. 8, a handle grip 3, which functions as a grip when opening a vehicle door, is arranged on a vehicle door panel 2. A door handle device 311 for a vehicle includes a frame 4 arranged inside the door panel 2, the handle grip 3 arranged outside the door panel 2, and a fastening piece (shaft supporting member) 5 fixed to the frame 4.

The frame 4 extends in the forward and rearward direction of the vehicle and is fixed to the door panel 2 by a nut 212 and a bolt 213. The frame 4 has two openings 4*a* and 4*b* arranged on both ends of the frame 4 in the longitudinal direction of the frame 4. The door panel 2 has openings 2*a* and 2*b* arranged at positions corresponding to the openings 4*a* and 4*b* of the frame 4.

The handle grip 3 has an elongated outer shape. The handle grip 3 has a first end (left end in FIG. 8) on which a pivot shaft 3*a* that is supported on the frame 4 in a pivotal manner is arranged and a second end (right end in FIG. 8) on which an interlocked portion 3*b* that is interlocked with a door lock mechanism is arranged. The pivot shaft 3*a* of the handle grip 3 is arranged on a distal end of a leg portion 3*d* arranged to extend from a first end of an external portion 3*c*, which serves as a main body of the handle grip 3. The leg portion 3*d* of the handle grip 3 is inserted in the opening 2*a* of the door panel 2 and the opening 4*a* of the frame 4, and the pivot shaft 3*a* of the handle grip 3 is held by a support portion 4*c* arranged on the frame 4.

The interlocked portion 3*b* of the handle grip 3 is arranged on a distal end of a leg portion 3*e* arranged to extend from a second end of the external portion 3*c*. The leg portion 3*e* of the handle grip 3 is inserted in the opening 2*b* of the door panel 2 and the opening 4*b* of the frame 4, and the interlocked portion 3*b* of the handle grip 3 is engaged with a bell crank arm 14. The bell crank arm 14 is connected to the door lock mechanism (not shown) arranged inside the door panel 2.

Figure 9:
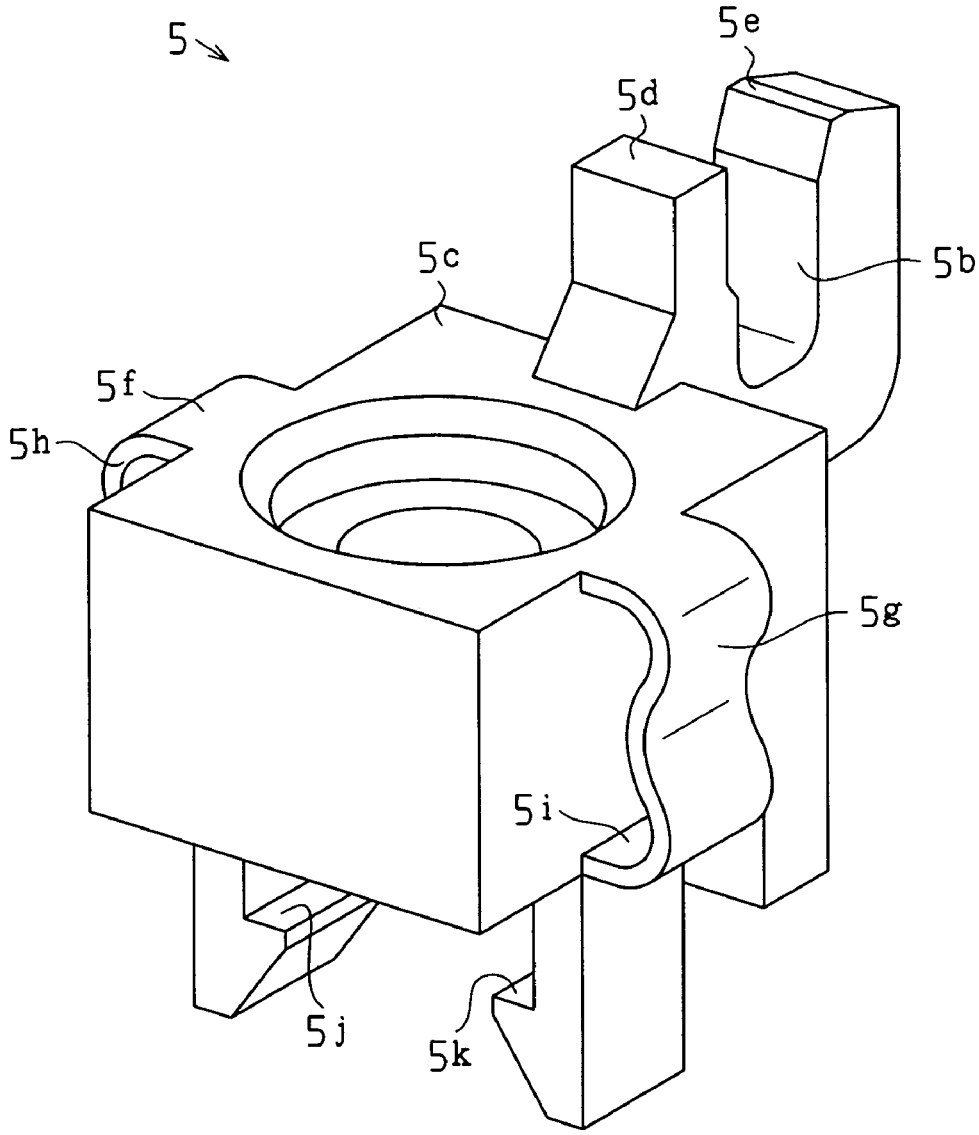
FIG. 9 is a perspective view showing a fastening piece included in a door handle device of FIG. 8.
Figure 10B:
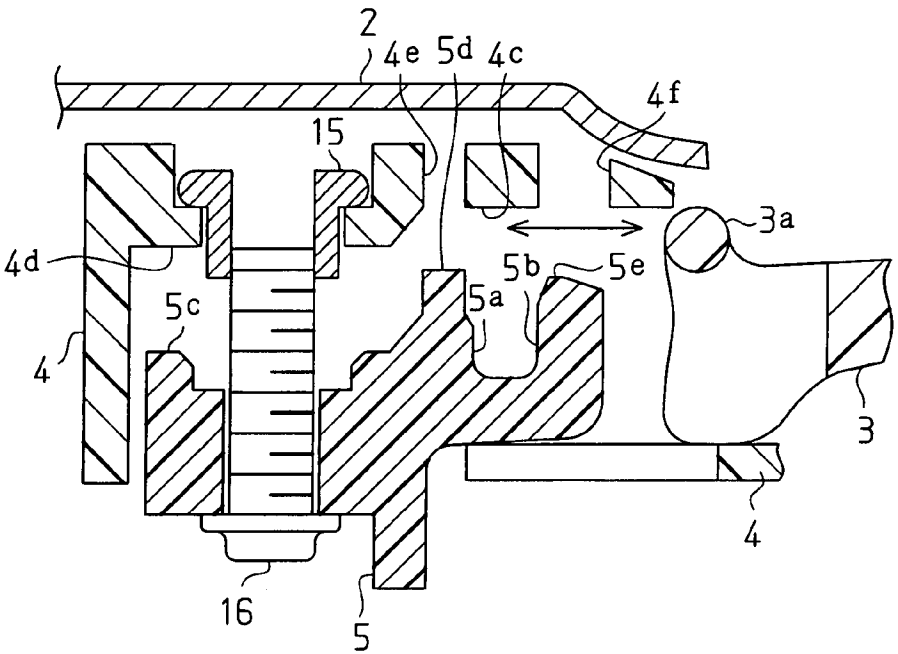
FIGS. 10(*a*) and 10(*b*) are cross-sectional views showing a support structure in which the fastening piece of FIG. 9 supports a pivot shaft of a handle grip.
Figure 10A:
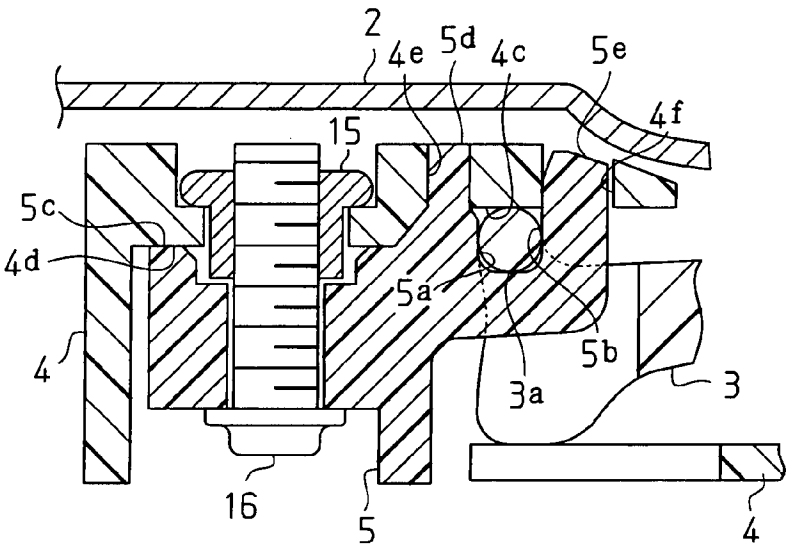

The fastening piece 5 is arranged in the vicinity of the support portion 4*c* of the frame 4 and configured to restrict movement of the pivot shaft 3*a* in the longitudinal direction of the handle grip 3 (hereafter may simply be referred to as longitudinal direction). FIG. 9 is a perspective view showing the fastening piece 5, and FIG. 10 is a cross-sectional view showing a support structure in which the fastening piece 5 of FIG. 10 supports the pivot shaft 3*a* of the handle grip 3. The fastening piece 5 is set in a fastened state shown in FIG. 10(*a*) when the assembling processes of the door handle device 311 are completed and may be set in a tentatively assembled state shown in FIG. 10(*b*) during the assembling processes. In the fastened state shown in FIG. 10(*a*), the fastening piece 5 is fastened to the frame 4 by a nut (female screw portion) 15 and a bolt (fastening member or male screw member) 16. In the tentatively assembled state shown in FIG. 10(*b*), the fastening piece 5 is supported by the frame 4 at a position separated from the position at which the fastening piece 5 is fixed to the frame 4 (at a position spaced from the position of the fastened state).

The fastening piece 5 includes support portions 5*a* and 5*b* having substantially U-shaped cross-sections for accommodating the pivot shaft 3*a* of the handle grip 3. In the fastened state, the fastening piece 5 is fixed to the frame 4 in the manner described below. The nut 15 is fixed to the frame 4. When the bolt 16 is fastened with the nut 15 that is fixed to the frame 4, a contact surface 5*c* of the fastening piece 5 and a contact surface 4*d* of the frame 4 come into contact with each other. Guide portions 5*d* and 5*e* of the fastening piece 5 are inserted in openings 4*e* and 4*f* of the frame 4 to position the support portions 5*a* and 5*b*. As a result, the support portions 5*a* and 5*b* of the fastening piece 5 restrict movement of the pivot shaft 3*a* in the longitudinal direction. Further, the support portion 4*c* of the frame 4 and the support portions 5*a* and 5*b* of the fastening piece 5 support the pivot shaft 3*a* of the handle grip 3 in a pivotal manner.

In the tentatively assembled state, the fastening piece 5 is released from the nut 15 and the bolt 16 is released, and the contact surface 5*c* of the fastening piece 5 and the contact surface 4*d* of the frame 4 are spaced from each other. In this state, the guide portions 5*d* and 5*e* of the fastening piece 5 are disengaged from the openings 4*e* and 4*f* of the frame 4, and the pivot shaft 3*a* of the handle grip 3 is not supported by the support portions 5*a* and 5*b* of the fastening piece 5. Thus, the pivot shaft 3*a* of the handle grip 3 is movable in the longitudinal direction (direction indicated using a solid line in FIG. 10(*b*)), and the handle grip 3 is removable from the frame 4.

Figure 11:
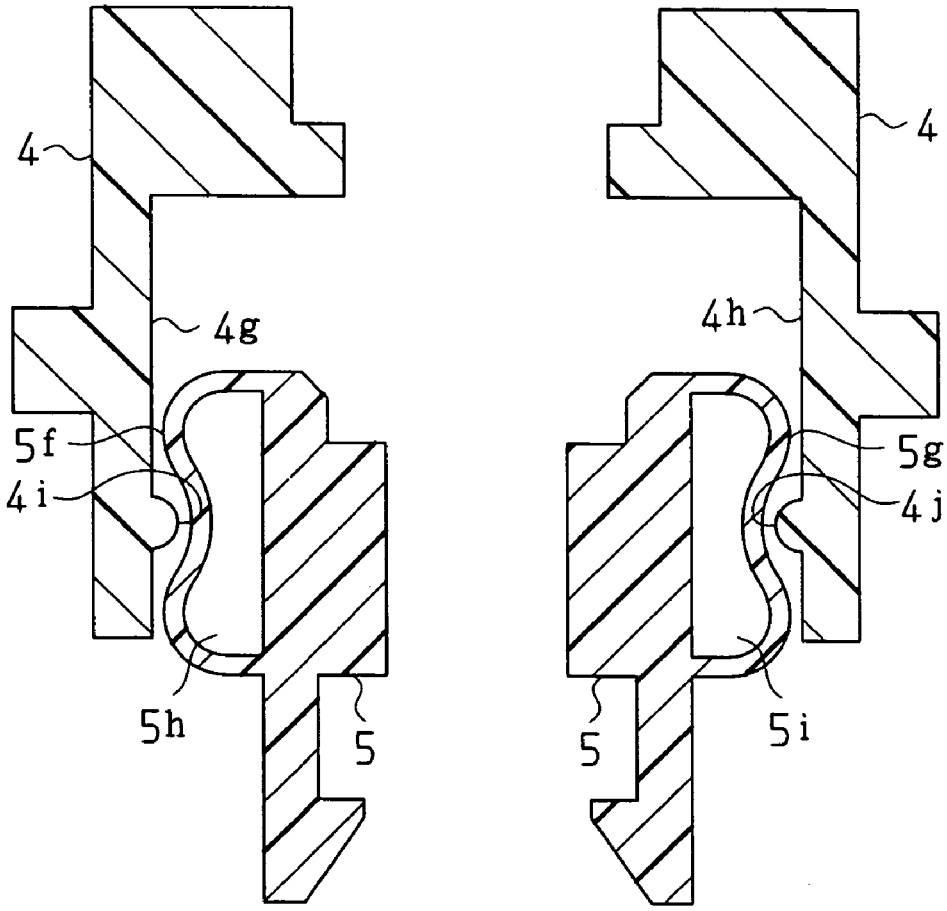
FIG. 11 is a cross-sectional view taken along line B-B in FIG. 8 showing a state in which the fastening piece of FIG. 9 is temporarily attached to a frame.

A support structure in which the fastening piece 5 is supported by the frame 4 in the tentatively assembled state of the fastening piece 5 will now be described. FIG. 11 shows a support structure in which the frame 4 supports the fastening piece 5 in the tentatively assembled state. FIG. 11 is a cross-sectional view taken along line B-B in FIG. 8. The frame 4 has projections 4*i* and 4*j* that are respectively arranged on flat surfaces 4*g* and 4*h*, which face each other and extend in the direction in which the bolt 16 is fastened (vertical direction in FIG. 11). The fastening piece 5 has temporary attachment recesses 5*f* and 5*g* respectively formed on flat surfaces that face the flat surfaces 4*g* and 4*h* of the frame 4. Hollow portions 5*h* and 5*i* are respectively formed inside the temporary attachment recesses 5*f* and 5*g* in a manner that walls defining the temporary attachment recesses 5*f* and 5*g* are easily and elastically deformed inwards. When the projections 4*i* and 4*j* are engaged with the temporary attachment recesses 5*f* and 5*g* as shown in FIG. 11, the fastening piece 5 is held on the frame 4 in a temporarily attached state. Since the walls defining the temporary attachment recesses 5*f* and 5*g* of the fastening piece 5 are easily deformed, the fastening piece 5 is released from the tentatively assembled state without applying a large load.

Figure 12:
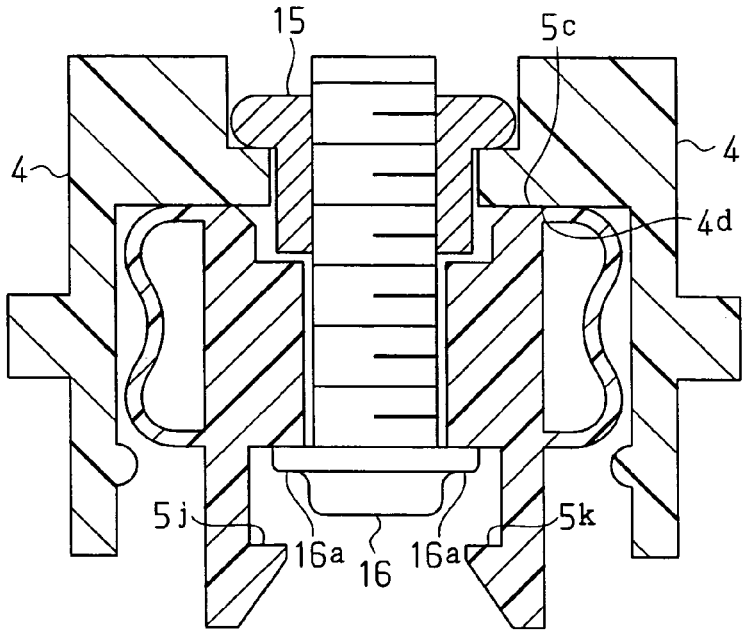
FIG. 12 is a cross-sectional view showing a state in which the fastening piece of FIG. 9 is fastened to the frame.

The operation for moving the fastening piece 5 in the fastened state will now be described. When, for example, the handle grip 3 is to be replaced or repaired, the fastening piece 5 in the fastened state must be moved and be set in the tentatively assembled state in which the handle grip 3 is removable. FIG. 12 is a cross-sectional view taken along line B-B of a fixing portion of the fastening piece 5 in the fastened state, and FIGS. 13 and 14 are cross-sectional views taken along line B-B of the fixing portion of the fastening piece 5 in the tentatively assembled state.

To move the fastening piece 5 in the fastened state, the bolt 16 is first rotated in the loosening direction. The nut 15 is fixed to the frame 4. Thus, as the bolt 16 rotates, the bolt 16 moves away from the frame 4 (downward in FIG. 12). When the bolt 16 is moved by a predetermined amount, a contact surface 16*a* of the bolt 16 comes in contact with engagement portions 5*j* and 5*k* arranged on the fastening piece 5. As the bolt 16 continues to move, the fastening piece 5 also moves together with the bolt 16 so that the contact surface 5*c* of the fastening piece 5 becomes spaced from the contact surface 4*d* of the frame 4. Then, the fastening piece 5 is moved to the position at which the fastening piece 5 is in the tentatively assembled state shown in FIG. 13. In this state, the handle grip 3 is removable. In this way, the fastening piece 5 is moved from the fastened state to the tentatively assembled state by rotating the bolt 16 in the loosening direction. This eliminates the operation of, for example, removing the fastening piece 5 after loosening the bolt 16, and improves efficiency in assembling processes.

Figure 13:
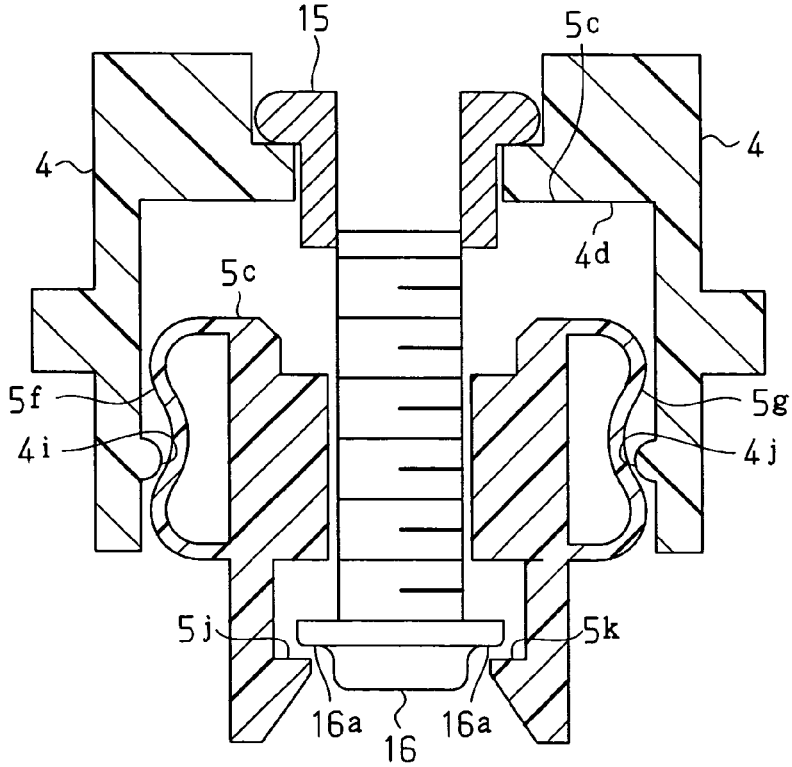
FIG. 13 is a cross-sectional view showing a state in which the fastening piece of FIG. 9 is temporarily attached to the frame with a bolt being loosened.
Figure 14:
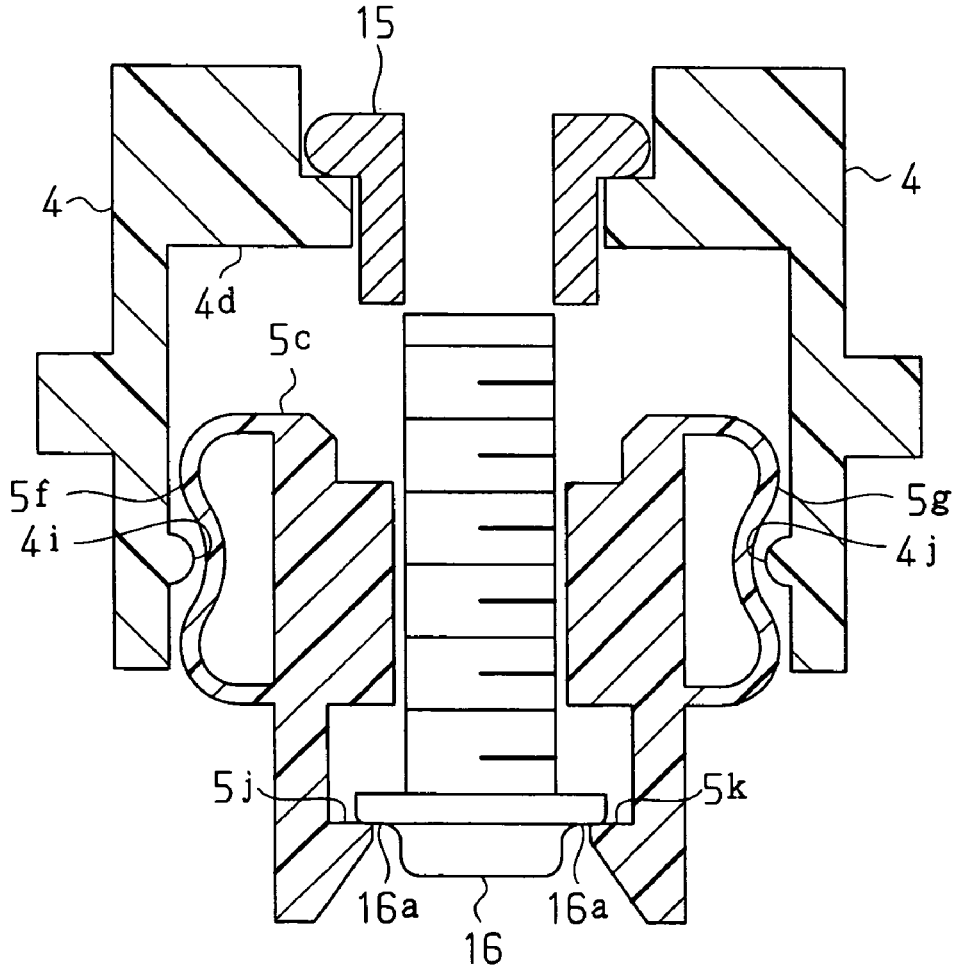
FIG. 14 is a cross-sectional view showing a state in which the fastening piece of FIG. 9 is temporarily attached to the frame with the bolt being released from a nut.

Further, when the bolt 16 is rotated continuously in the loosening direction from the tentatively assembled state shown in FIG. 13, the nut 15 and the bolt 16 that have been fastened together are released as shown in FIG. 14. Here, the projections 4*i* and 4*j* of the frame 4 and the temporary attachment recesses 5*f* and 5*g* of the fastening piece 5 remain engaged with each other. Thus, the fastening piece 5 remains in the tentatively assembled state. As a result, the fastening piece 5 is prevented from falling off the frame 4 even if the bolt 16 is loosened too much when moving the fastening piece 5.

The operation of the vehicle door handle device 311 will be now described. When the assembling of the vehicle door handle device 311 is completed, the fastening piece 5 is in the fastened state. To open the door 8 of the vehicle, when the door 8 is in the closed state, the handle grip 3 is gripped and pulled outwards of the door 8. The support portion 4*c* of the frame 4 and the support portions 5*a* and 5*b* of the fastening piece 5 pivotally support the pivot shaft 3*a* of the handle grip 3. Thus, the handle grip 3 starts pivoting about the pivot shaft 3*a* without becoming loose in the longitudinal direction of the handle grip 3. As the handle grip 3 pivots, the interlocked portion 3*b* of the handle grip 3 actuates the bell crank arm 14, and the bell crank arm 14 drives the latch mechanism of the door lock mechanism. When the handle grip 3 is pivoted by a predetermined angle, the door lock mechanism is unlocked. This enables the door 8 to open and move in the opening direction.

The above embodiment has the advantages described below.

(1) In the above embodiment, the support portions 5*a* and 5*b* of the fastening piece 5 restrict movement of the pivot shaft 3*a* of the handle grip 3 in the longitudinal direction of the handle grip 3 in the fastened state in which the fastening piece 5 is fixed to the frame 4 by the nut 15 and the bolt 16. Thus, when the assembling of the vehicle door handle device 311 is completed, the handle grip 3 is prevented from becoming loose in the longitudinal direction.

(2) In the above embodiment, in the tentatively assembled state in which the pivot shaft 3*a* is removable from the frame 4, the fastening piece 5 is held by the frame 4. This enables the fastening piece 5 and the frame 4 to be handled as a single unit before the handle grip 3 is attached. As a result, in the processes of assembling the vehicle door handle device 311, the handle grip 3 is supported just by fastening the bolt 16 after the attachment of the handle grip 3. This improves the operability of the assembling processes. Further, the fastening piece 5 and the frame 4, which form a unit, are also advantageous in their handling during transportation or in their manufacturing management.

(3) In the above embodiments, the fastening piece 5 is supported by the frame 4 in a tentatively assembled state by the engagement of the projections 4*i* and 4*j* of the frame 4 and the temporary attachment recesses 5*f* and 5*g* of the fastening piece 5. This enables the fastening piece 5 to be held in the tentatively assembled state by the frame 4 without using additional members.

(4) In the above embodiments, the defining walls of the temporary attachment recesses 5*f* and 5*g* that are engaged with the projections 4*i* and 4*j* of the frame 4 are configured to easily elastically deform. Thus, the fastening piece 5 is held in or released from the tentatively assembled state without applying a large load. In other words, the projections 4*i* and 4*j* and the temporary attachment recesses 5*f* and 5*g* are disengaged without a large resistance. Thus, the fastening piece 5 is smoothly moved from the tentatively assembled state to the fastened state.

(5) In the above embodiment, when moving the fastening piece 5, which is in the fastened state, the bolt 16 is rotated in the loosening direction to move the bolt 16 in the direction in which the bolt 16 is spaced from the frame 4 so that the contact surface 16*a* of the bolt 16 comes in contact with the engagement portions 5*j* and 5*k* of the fastening piece 5. As a result, the fastening piece 5 is moved from the fastened state to the tentatively assembled state. More specifically, when the bolt 16 (fastening member) is moved as it is loosened, the bolt 16 engages the engagement portions 5*j* and 5*k* so that the fastening piece 5 (shaft supporting member) moves together with the bolt 16 from a position corresponding to the fastened state toward a position corresponding to the tentatively assembled state. The fastening piece 5 is moved from the fastened state to the tentatively assembled state simply by rotating the bolt 16 in the loosening direction. As a result, the efficiency of the assembling processes is improved. More specifically, when the fastening piece 5 is moved from the fastened state to, for example, replace the handle grip 3, the fastening piece 5 is moved to the position corresponding to the tentatively assembled state (state in which the handle grip 3 is removable from the frame 4) just by unfastening the bolt 16. This improves the efficiency of the assembling processes.

(6) In the above embodiment, when the bolt 16 is rotated in the loosening direction to move the fastening piece 5 from the fastened state to the tentatively assembled state, the nut 15 and the bolt 16, which are fastened together, are unfastened in the tentatively assembled state of the fastening piece 5. As a result, the fastening piece 5 is prevented from moving to the position at which the fastening piece 5 falls off from the frame 4 even when the bolt 16 is loosened too much.

The above embodiment may be modified in the following forms.

The two support portions 5*a* and 5*b* of the fastening piece 5 restrict movement of the pivot shaft 3*a* in the longitudinal direction in the above embodiments. However, just one of the support portions 5*a* and 5*b* may be arranged on the fastening piece 5, and the other one of the support portions may be arranged on the frame 4.

Although the fastening piece 5 is held in a tentatively assembled state by the frame 4 through the engagement of the projections 4*i* and 4*j* of the frame 4 with the temporary attachment recesses 5*f* and 5*g* of the fastening piece 5 in the above embodiment, the fastening piece 5 may be supported in the tentatively assembled state using a separate member.

Although the fastening piece 5 is fastened to the frame 4 with the nut 15 and the bolt 16 in the fastened state of the fastening piece 5 in the above embodiment, the fastening piece 5 may be fixed through another fastening method. For example, an engagement hook arranged on the fastening piece 5 may be engaged with the frame 4 (refer to the guide portions 50*b* in FIG. 5).

Although the nut 15 is fixed to the frame 4 in the above embodiment, a female screw portion corresponding to the nut 15 may be arranged directly on the frame 4.

A vehicle door handle device according to a fourth embodiment of the present invention will now be described.

Figure 15:
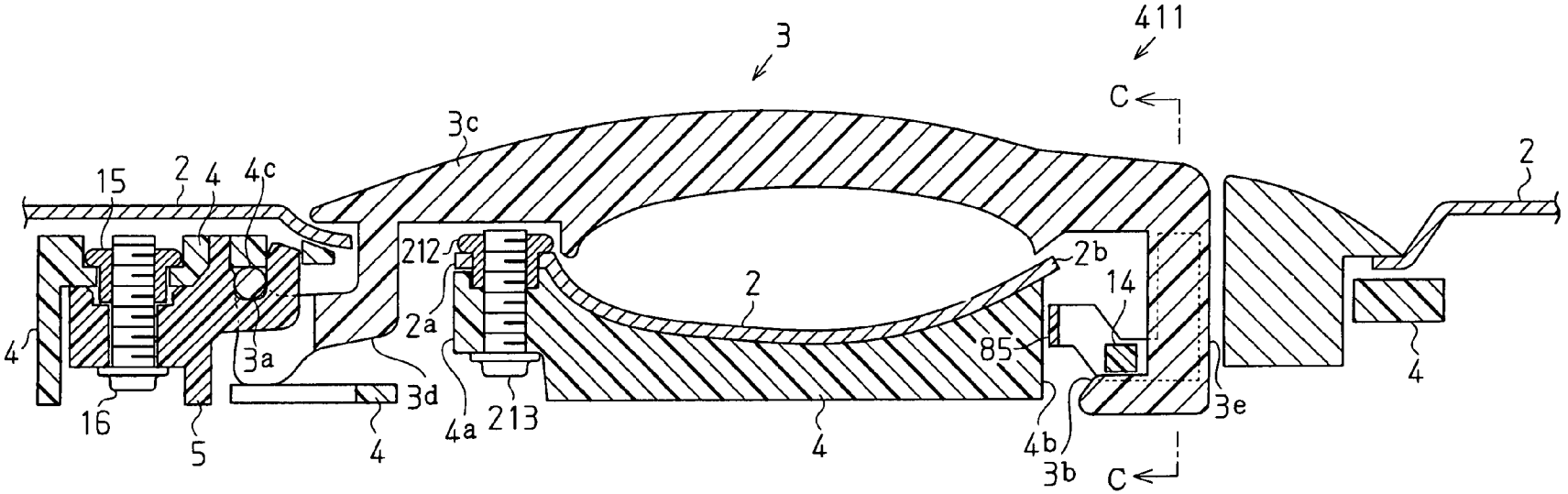
FIG. 15 is a cross-sectional view of a door handle device for a vehicle according to a fourth embodiment of the present invention.

As shown in FIG. 15, a door handle device 411 for a vehicle includes a guide member 85 fixed to a frame 4.

The frame 4 is made of a material having high strength, such as a resin containing glass fibers, to support a handle grip 3.

The guide member 85 is arranged in the vicinity of an opening 4*b* of the frame 4, and is fixed to the frame 4. The guide member 85 is configured to restrict movement of the handle grip 3 in the axial direction of a pivot shaft 3*a* by sliding a leg portion 3*e* of the handle grip 3 when the handle grip 3 is pivoted. For this purpose, the guide member 85 is made of a material having superior sliding characteristics. Further, the guide member 85 is made of a material having hardness that is lower than the material for the frame 4.

Figure 16:
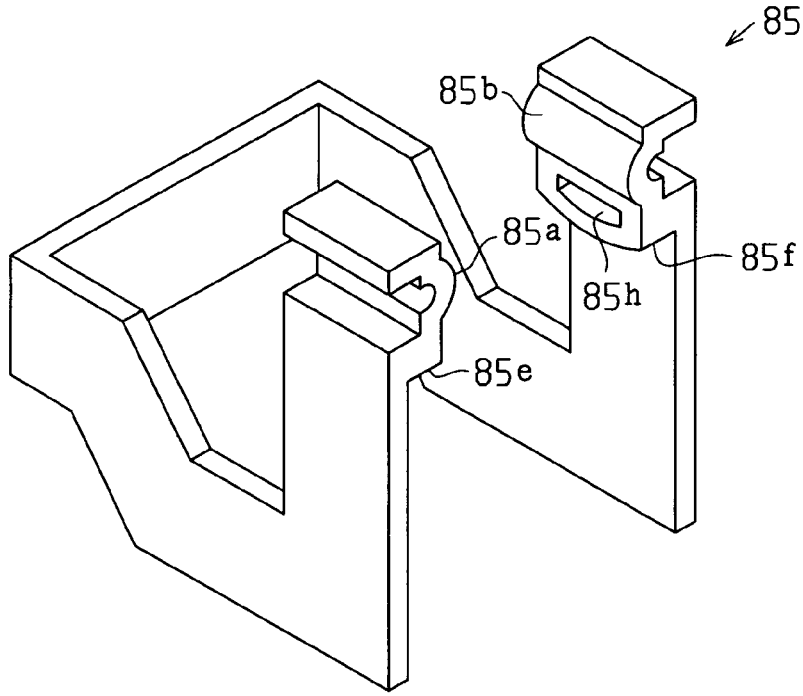
FIG. 16 is a perspective view showing a guide member included in the door handle device of FIG. 15.
Figure 17:
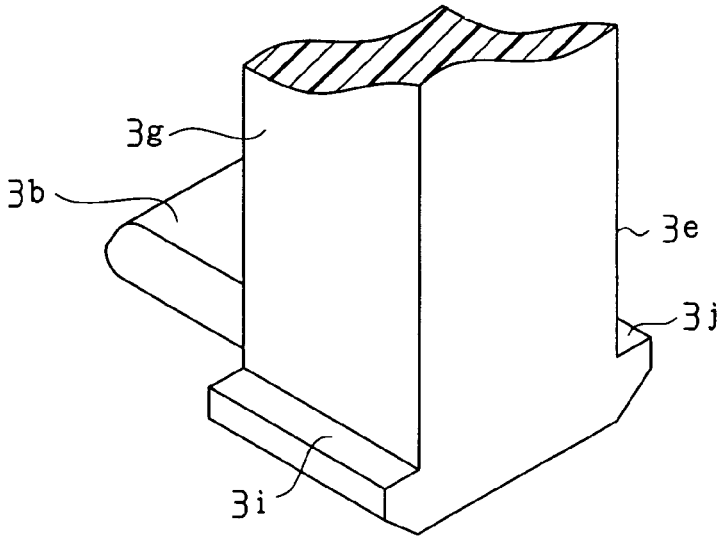
FIG. 17 is a perspective view showing a leg portion of a handle grip included in the door handle device of FIG. 15.
Figure 18A:
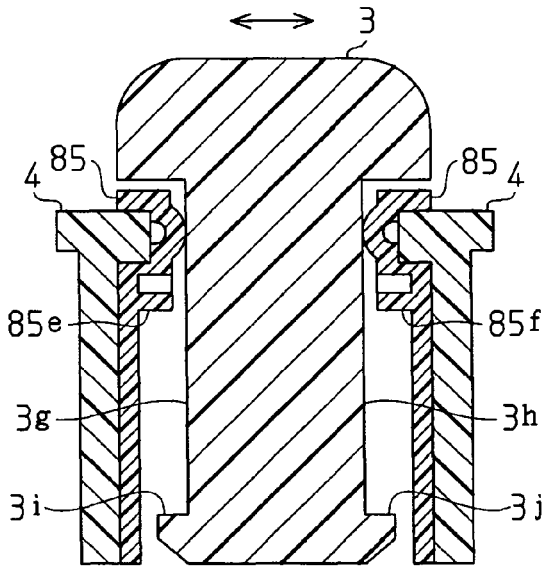
FIGS. 18(*a*) and 18(*b*) are cross-sectional views taken along line C-C in FIG. 15.
Figure 18B:
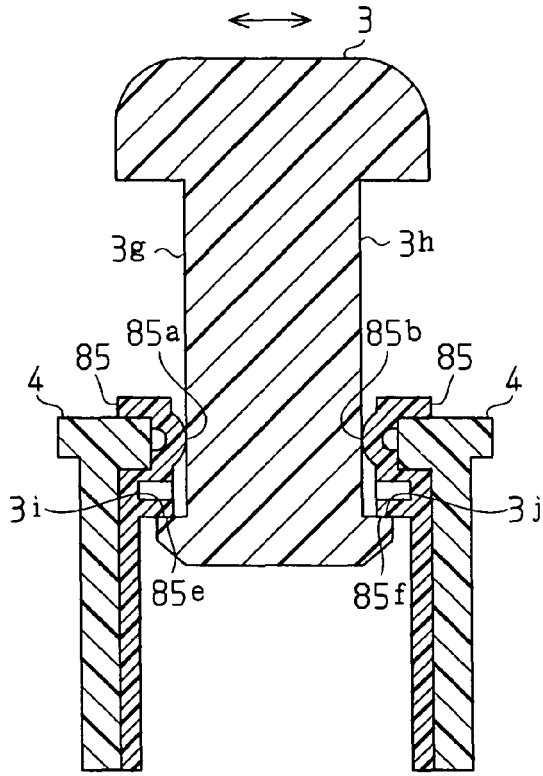

FIG. 16 is a perspective view showing the guide member 85, FIG. 17 is a perspective view showing the leg portion 3*e* of the handle grip 3, FIG. 18 is a cross-sectional view of the vehicle door handle device 411 taken along line C-C of FIG.

Figure 19:
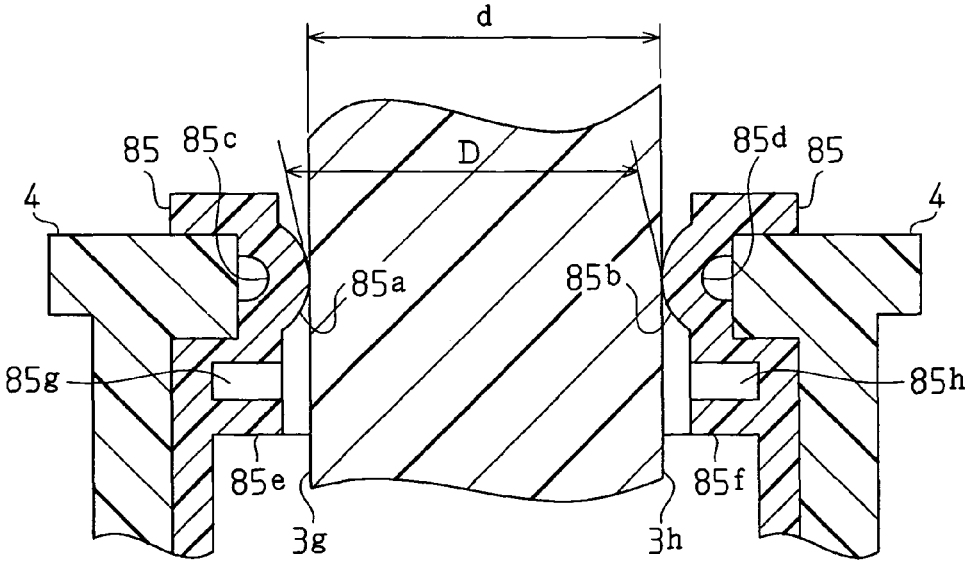
FIG. 19 is a partially enlarged view showing the main part of FIG. 18.
Figure 20:
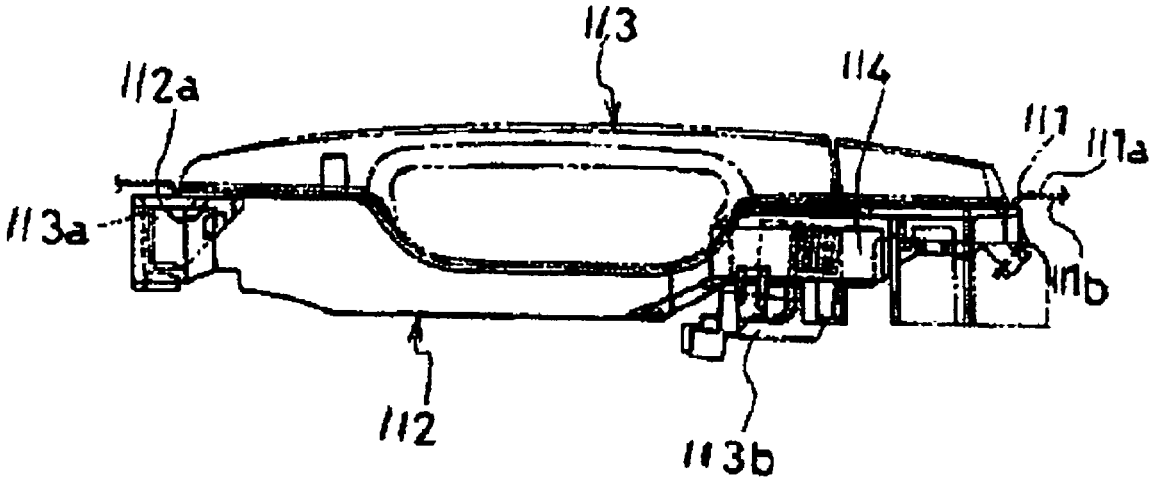
Fig. 20(Prior Art)
FIG. 20 is a cross-sectional view showing the structure of a conventional door handle device.

15, and FIG. 19 is a partially enlarged view showing the main part of FIG. 18. FIG. 18(*a*) is a cross-sectional view of the handle grip 3 taken at a non-operation position, and FIG. 18(*b*) is a cross-sectional view of the handle grip 3 taken at a pivot end position in the opening operation direction.

The guide member 85, which has a substantially U-shaped outer form, has guide portions 85*a* and 85*b* facing each other formed on a pair of opposing inner surfaces. The guide portions 85*a* and 85*b* are formed as projections. The guide portions 85*a* and 85*b* restrict movement of the handle grip 3 in the axial direction of the pivot shaft 3*a* (direction indicated by a solid line in FIG. 18) by sliding along slide portions 3*g* and 3*h* of the leg portion 3*e* of the handle grip 3. The distance D between the vertex of the guide portion 85*a* and the vertex of the guide portion 85*b* when the handle grip 3 is separated from the guide member 85 (refer to FIG. 19) is set to be smaller than the distance d between the slide portion 3*g* and the slide portion 3*h* of the leg portion 3*e*. Further, hollow portions 85*c* and 85*d* are respectively arranged on the rear surfaces of the guide portions 85*a* and 85*b* to enable the guide portions 85*a* and 85*b* to be easily and elastically deformed outwards. As a result, the guide portions 85*a* and 85*b* of the guide member 85 elastically support the leg portion 3*e* of the handle grip 3 in between and prevents the handle grip 3 from becoming loose in the axial direction of the pivot shaft 3*a*.

Further, the guide member 85 is configured to restrict the pivot range of the handle grip 3 in the opening operation direction. Contact portions 3*i* and 3*j* are arranged on the distal end of the leg portion 3*e* of the handle grip 3, and stopper portions 85*e* and 85*f* are arranged on the guide member 85. As shown in FIG. 18(*b*), the contact portions 3*i* and 3*j* of the handle grip 3 come in contact with the stopper portions 85*e* and 85*f* of the guide member 85 at the pivot end position of the handle grip 3 in the opening operation direction to restrict the pivot range of the handle grip 3. Hollow portions 85*g* and 85*h* are arranged on the rear side (upper side in FIG. 18) of the stopper portions 85*e* and 85*f* of the guide member 85 so that the stopper portions 85*e* and 85*f* are configured to be easily and elastically deformed toward the rear. As a result, the contact portions 3*i* and 3*j* of the handle grip 3 elastically come in contact with the stopper portions 85*e* and 85*f* of the guide member 85 at the pivot end position of the handle grip 3 in the opening operation direction. This reduces the hitting noise of the stopper portions 85*e* and 85*f* against the contact portions 3*i* and 3*j*.

The operation of the vehicle door handle device 411 will now be described. To open the vehicle door when the vehicle door is in the closed state, the handle grip 3 is gripped and pulled outwards of the vehicle door. Then, the handle grip 3 starts pivoting about the pivot shaft 3*a*, and the slide portions 3*g* and 3*h* of the handle grip 3 start moving while sliding along the guide portions 85*a* and 85*b* of the guide member 85 (FIG. 18(*a*)). As the handle grip 3 pivots, the interlocked portion 3*b* of the handle grip 3 actuates the bell crank arm 14, and the bell crank arm 14 drives the latch mechanism of the door lock mechanism. When the handle grip 3 is pivoted by a first predetermined angle, the door lock mechanism is unlocked. This enables to door to open.

The handle grip 3 is formed to rotate in the opening operation direction even after the door lock mechanism is unlocked. When the operation to rotate the handle grip 3 in the opening operation direction is continued, the contact portions 3*i* and 3*j* of the handle grip 3 come in contact with the stopper portions 85*e* and 85*f* of the guide member 85 when the handle grip 3 rotates by a second predetermined angle (FIG. 18(*b*)). This restricts the range of rotation of the handle grip 3 in the opening operation direction.

The above embodiment has the advantages described below.

(11) In the above embodiment, the contact portions 3*i* and 3*j* of the handle grip 3 elastically come in contact with the stopper portions 85*e* and 85*f* of the guide member 85 at the pivot end position of the handle grip 3 in the opening operation direction. This reduces the hitting noise of the contact portions 3*i* and 3*j* and the stopper portions 85*e* and 85*f* generated at the pivot end position.

(12) In the above embodiment, the guide portions 85*a* and 85*b* of the guide member 85 elastically support the slide portions 3*g* and 3*h* of the handle grip 3 in between to restrict movement of the handle grip 3 in the axial direction of the pivot shaft 3*a*. Thus, when the handle grip 3 is pivoted, the loosening of the handle grip 3 in the axial direction of the pivot shaft 3*a* is prevented without applying a large load to the handle grip 3. Further, the guide portions 85*a* and 85*b* elastically support the slide portions 3*g* and 3*h* in between and variations among products in the distance D between the distal end of the guide portion 85*a* and the distal end of the guide portion 85*b* and the distance d between the slide portion 3*g* and the slide portion 3*h* of the leg portion 3*e* are absorbed. Further, the loosening of the handle grip 3 in the axial direction of the pivot shaft 3*a* is prevented.

(13) In the above embodiment, the guide member 85 for restricting movement of the leg portion 3*e* of the handle grip 3 in the axial direction of the pivot shaft 3*a* has the stopper portions 85*e* and 85*f* that are easily and elastically deformed. More specifically, the stopper portions 85*e* and 85*f* are integrally formed with the guide member 85. This eliminates the need for arranging an additional stopper member for reducing hitting noise and prevents the number of components from increasing.

(14) In the above embodiment, the guide member 85 is made of a material having a lower hardness than the material for the frame 4. Thus, the stopper portions 85*e* and 85*f* of the guide member 85 are easily and elastically deformed while the frame 4 is maintained to have high strength. This reduces the hitting noise of the contact portions 3*i* and 3*j* and the stopper portions 85*e* and 84*f* generated at the pivot end position of the handle grip 3. Further, the guide portions 85*a* and 85*b* of the guide member 85 are easily and elastically deformed. This reduces the load applied to the handle grip 3 when the handle grip 3 is pivoted.

(15) In the above embodiment, the frame 4 is made of a material having high strength, and the guide member 85 is made of a material having superior sliding characteristics. This increases the freedom for material selection as compared with when, for example, the frame 4 and the guide member 85 are formed integrally with each other.

(16) The handle grip 3 has the first end, on which the pivot shaft 3*a* is arranged, and the second end, on which the interlocked portion 3*b* that is interlocked with the door lock mechanism and the contact portions 3*i* and 3*j* that come in contact with the stopper portions 85*e* and 85*f* at the pivot end position are arranged. Thus, the pivot shaft 3*a*, the interlocked portion 3*b*, and the contact portions 3*i* and 3*j* of the handle grip 3 are efficiently arranged.

The above embodiment may be modified in the following forms.

Although the handle grip 3 is a grip type door handle in the above embodiment, the handle grip 3 may be a flap type door handle.

Although the guide member 85 has the two stopper portions 85*e* and 85*f* in the above embodiment, the guide member 85 may have one stopper portion or three or more stopper portions.

Although the guide member 85 is made of a material having a lower hardness than the material for the frame 4 in the above embodiment, the materials for the guide member 85 and the frame 4 may be selected without considering hardness of the materials.

Although the guide portions 85*a* and 85*b* of the guide member 85 elastically support the slide portions 3*g* and 3*h* of the handle grip 3 in between in the above embodiment, gaps may be formed between the guide portions 85*a* and 85*b* and the slide portions 3*g* and 3*h*.

The invention claimed is:

1. A vehicle door handle device for mounting to a vehicle door panel having front and rear surfaces, the vehicle door handle device comprising:

a base member fixable to the rear surface of the door panel and a grip member arranged on the base member from the front surface of the door panel so that the grip member is supported on the base member in a tiltable manner, a pivot shaft arranged on the grip member;

a shaft supporting member having a shaft supporting recess for supporting the pivot shaft in a pivotal manner with respect to the base member; and a fastening mechanism, the fastening mechanism joining the base member and the shaft supporting member together in a vicinity of the shaft supporting recess, the fastening mechanism configured to be movable to a first position and a second position, the fastening mechanism when moved toward the first position engages the shaft supporting member to move the shaft supporting member away from the base member to create a space between the shaft supporting member and the base member through which space the pivot shaft passes to enter and leave the shaft supporting recess, and the fastening mechanism when moved toward the second position engages the shaft supporting member to move the shaft supporting member to cover the shaft supporting recess and close the space between the shaft supporting member and the base member to prevent the pivot shaft from leaving the shaft supporting recess, wherein the shaft supporting member restricts movement of the pivot shaft in a longitudinal direction of the grip member with respect to the base member when the fastening mechanism is in the second position.

2. The vehicle door handle device according to claim 1, wherein:

the grip member includes a support arm having a pair of opposing walls facing toward each other, the pivot shaft is arranged on the support arm to connect the opposing walls to each other, and the shaft supporting member is accommodated between the opposing walls.

3. The vehicle door handle device according to claim 1, wherein:

a flexible portion capable of contacting the pivot shaft is formed on an inner wall of the shaft supporting recess.

4. The vehicle door handle device according to claim 3, wherein:

the shaft supporting member has a through hole extending around the shaft supporting recess in the same direction as the direction in which the pivot shaft extends, wherein a portion of the shaft supporting member between the through hole and the inner wall of the shaft supporting recess forms the flexible portion.

5. The vehicle door handle device according to claim 3, wherein:

the shaft supporting recess is defined by three inner walls, and the flexible portion is formed on at least one of the three inner walls.

6. The vehicle door handle device according to claim 1, wherein:

the base member has a shaft supporting recess for pivotally supporting the pivot shaft.

7. The vehicle door handle device according to claim 1, wherein:

the pivot shaft is cylindrical and extends in a direction perpendicular to the longitudinal direction of the grip member.

8. The vehicle door handle device according to claim 1, wherein the fastening mechanism includes a fastening member which is provided at the shaft supporting member and connected to the base member in such a manner that when the fastening member is operated in a first direction, the shaft supporting member is brought into engagement with the base member, and when the fastening member is operated in a second direction, the shaft supporting member is disengaged from the base member.

9. The vehicle door handle device according to claim 8, wherein:

one of the base member and the shaft supporting member includes a projection, and the other one of the base member and the shaft supporting member has a wall defining a temporary attachment recess, wherein the projection is engaged with the temporary attachment recess so that the base member holds the shaft supporting member in the tentatively assembled state, and the wall defining the temporary attachment recess is elastically deformable.

10. The vehicle door handle device according to claim 8, wherein:

the shaft supporting member has an engagement portion engageable with the fastening member to restrict separation of the fastening member from the shaft supporting member.

11. The vehicle door handle device according to claim 10, wherein:

the fastening member is a male screw member, and the base member has a female screw portion fastened with the male screw member, wherein when moving the fastening member while loosening the fastening member, the fastening member is engaged with the engagement portion so that the shaft supporting member moves together with the fastening member toward a position corresponding to the tentatively assembled state.

12. The vehicle door handle device according to claim 11, wherein:

the male screw member and the female screw portion are disengageable when the shaft supporting member is temporarily attached to the base member.

13. The vehicle door handle device according to claim 1, comprising:

a guide member fixed to the base member, wherein the guide member guides the grip member so that the grip member slides when pivoted and restricts movement of the grip member in an axial direction of the pivot shaft, and the guide member includes a stopper portion that elastically comes in contact with the grip member and restricts further pivoting of the grip member when the grip member is pivoted to a pivot end position in a direction in which the vehicle door opens.

14. The vehicle door handle device according to claim 13, wherein:

the guide member elastically holds the grip member to restrict movement of the grip member in the axial direction of the pivot shaft.

15. The vehicle door handle device according to claim 13, wherein:

the guide member is made of a material having a lower hardness than a material for the base member.

16. The vehicle door handle device according to claim 13, wherein:

the grip member has a first end and a second end, and the pivot shaft is arranged on the first end, and an interlocked portion interlocked with a door lock mechanism and a contact portion that comes in contact with the stopper portion at the pivot end position are arranged on the second end.

* * * * *